US008382326B2

(12) United States Patent
Tamura

(10) Patent No.: US 8,382,326 B2
(45) Date of Patent: Feb. 26, 2013

(54) LIGHT SOURCE UNIT, LIGHTING APPARATUS AND NOTICE BEARING APPARATUS

(75) Inventor: Satoru Tamura, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 66 days.

(21) Appl. No.: 12/918,151

(22) PCT Filed: Feb. 13, 2009

(86) PCT No.: PCT/JP2009/052375

§ 371 (c)(1),
(2), (4) Date: Aug. 18, 2010

(87) PCT Pub. No.: WO2009/104518

PCT Pub. Date: Aug. 27, 2009

(65) Prior Publication Data

US 2010/0327752 A1 Dec. 30, 2010

(30) Foreign Application Priority Data

Feb. 19, 2008 (JP) ..... 2008-037842

(51) Int. Cl.
*F21V 29/00* (2006.01)

(52) U.S. Cl. ..... 362/249.02; 362/800; 362/235; 362/249.11

(58) Field of Classification Search ..... 362/249.02, 362/800, 249.11, 235
See application file for complete search history.

(56) References Cited

U.S. PATENT DOCUMENTS 4,654,766 A * 3/1987 Tung ..... 362/249.14
5,128,842 A * 7/1992 Kenmochi ..... 362/95
6,017,241 A * 1/2000 Komai ..... 439/419
6,027,952 A * 2/2000 Liu ..... 438/26
6,371,629 B1 * 4/2002 Martinez ..... 362/363
6,505,956 B1 * 1/2003 Priddy et al. ..... 362/249.04
6,566,824 B2 * 5/2003 Panagotacos et al. ..... 315/291
6,837,598 B2 * 1/2005 Marcus ..... 362/374
6,846,093 B2 * 1/2005 Swaris et al. ..... 362/237
6,932,495 B2 * 8/2005 Sloan et al. ..... 362/294
7,036,962 B2 * 5/2006 Chan ..... 362/407
7,165,863 B1 * 1/2007 Thomas et al. ..... 362/219
7,273,300 B2 * 9/2007 Mrakovich ..... 362/249.01

(Continued)

FOREIGN PATENT DOCUMENTS

JP 2003-68130 A 3/2003
JP 2003-86006 A 3/2003

(Continued)

*Primary Examiner* — Anabel Ton
(74) *Attorney, Agent, or Firm* — Birch, Stewart, Kolasch & Birch, LLP

(57) ABSTRACT

It is provided with a light source unit that can be thinner. Further, it is provided with a lighting apparatus and a notice bearing apparatus utilizing the light source unit.

A light source unit 10 is configured with a plurality of LED modules 3, 3 and a constant current supplying section 2 consisting of electric components for holding constant of current supplied to the plurality of LED modules 3, 3. The plurality of LED modules 3, 3 and the electric components are aligned on a rectangular plate 11 of a module casing 1. Thus, it is possible to manufacture the light source unit 10 to be thinner. The electric components are arranged between the plurality of LED modules 3, 3. Thus, it is possible to reduce cable length installed in the light source unit 10 and to facilitate the installing works of the cable.

19 Claims, 15 Drawing Sheets

U.S. PATENT DOCUMENTS

| | | | | |
|---|---|---|---|---|
| 7,926,976 | B2 * | 4/2011 | Schinzel-Kolb et al. | 362/249.02 |
| 2003/0063463 | A1 * | 4/2003 | Sloan et al. | 362/238 |
| 2003/0071581 | A1 * | 4/2003 | Panagotacos et al. | 315/185 R |
| 2003/0218878 | A1 * | 11/2003 | Swaris et al. | 362/234 |
| 2003/0223235 | A1 * | 12/2003 | Mohacsi et al. | 362/240 |
| 2004/0196636 | A1 | 10/2004 | Kim | |
| 2009/0026485 | A1 | 1/2009 | Urano et al. | |

FOREIGN PATENT DOCUMENTS

| | | | |
|---|---|---|---|
| JP | 2004-310090 | A | 11/2004 |
| JP | 2006-100052 | A | 4/2006 |
| JP | 2007-36132 | A | 2/2007 |
| JP | 2007-43126 | A | 2/2007 |
| JP | 2007-213881 | A | 8/2007 |

* cited by examiner

LIGHT SOURCE UNIT, LIGHTING APPARATUS AND NOTICE BEARING APPARATUS

This application is the national phase under 35 U.S.C.§371 of PCT International Application No. PCT/JP2009/052375 which has an International filing date of Feb. 13, 2009 and designated the United States of America.

BACKGROUND OF THE INVENTION

1. Field of the Invention

The present invention relates to a light source unit having a light source and an electric component for supplying current to the light source. Further, the present invention relates to a lighting apparatus and a notice bearing apparatus utilizing the light source unit.

2. Description of Related Art

Conventionally, several methods are known to illuminate a notice bearing apparatus, such as a signboard or an indicator, with utilizing a light source in order to be visible even in the night. For example, it is known about a method (exteriorly illuminating method) that mounts a color film or a color poster on a plane and illuminates from the front with a light source, a method (interiorly illuminating method) that sets a light source behind a transparent material (such as a plastic plate) and illuminates from the back, a method (self illuminating method) that machines a light source (such as a fluorescent lamp and a neon tube lamp) to be a desired shape (such as a character and a figure to be visible), and the like.

The light source such as the fluorescent lamp and the neon tube lamp has a limited short life, which causes to require frequent maintenances for replacing the light source. In the case that such the light source is set at a higher place (e.g., an outside signboard), a user happens to take larger burden. Thus, there is a need for reducing the maintenance frequency. Since a light emitting diode (LED) has been recently improved to emit a high intensity light, the conventional light source such as the fluorescent lamp and the neon tube lamp is exchanged to such the LED that has lower power consumption, longer life and the like.

In the case of the interiorly illuminating method and the self illuminating method that require arranging light sources based on the shape of a character or a figure to be visible and making the light sources emit light in order to display the character or the figure, the design flexibility is especially required for arranging the light sources at desired positions. The LED can satisfy such the requirement since the LED is a small light source and it is possible to manufacture an emitting light surface of LED in a desired shape.

In the case that such the LED is utilized as the light source and then respective LEDs must be arranged according to the shape of the character or the figure, a larger burden is required for fixing works and cable installing works of many LEDs. Thus, a light source unit is utilized, into which many LEDs are packaged without compromising the design flexibility for arranging the LEDs.

For example, it is known to connect a plurality of such the light source units and to supply constant current to the plurality of connected light source units from a constant current supplying circuit provided with a power supply section. Such the configuration has a problem causing variations in brightness due to variations in current supplied to the LEDs, because of variations in the voltage-current characteristic among manufactured LEDs, changes in the forward voltage based on heat, changes in the voltage reduction at the cable and the like. Thus, it is proposed to utilize light source units, each of which interiorly possesses the constant current supplying circuit (for example, Patent Document 1).

The light source unit proposed by the Patent Document 1 is configured to have a casing whose top face is opened, to include a plurality of LEDs and a circuit board mounting a transformer, a rectification circuit, a constant voltage supplying circuit and a constant current supplying circuit, and to contain the plurality of LEDs and the circuit board within the casing. This configuration can supply constant current to LEDs in each light source unit, and can implement preventing the variations in brightness with properly keeping the design flexibility for arranging the LEDs.

[Patent Document 1] Japanese Patent Application Laid-Open No. 2004-310090

SUMMARY OF THE INVENTION

However, the light source unit proposed by the Patent Document 1 is configured to have a board mounting the LEDs and to arrange electric components such as the transformer on the back surface of the board, and then happens to have larger thickness because containing the board whose front surface mounts the LEDs and whose back surface mounts the electric components. Thus, there is a problem causing larger thickness of notice bearing apparatus, such as a signboard and an indicator, configured with the combined light source units, as each of the light source units is getting to have larger thickness.

The present invention is made in view of such circumstances, and has an object to provide a light source unit that can be thin, and further to provide a lighting apparatus and a notice bearing apparatus utilizing the light source unit.

A light source unit according to the present invention comprises: a plurality of light sources; and an electric component configuring a circuit that supplies current to the plurality of light sources, wherein the electric component is arranged between the plurality of light sources.

According to an aspect of the present invention, it is possible to manufacture the light source unit to be thin, with properly arranging the plurality of light sources and the electric component. As the electric component is arranged between the plurality of light sources, it is further possible to connect the electric component and the light source with an electric cable preventing across another electric cable, in the case that a power supply electric cable is connected to the electric component and the electric component is connected to respective light sources with the electric cable. Therefore, it is possible to reduce the length of the cable in the light source unit and to facilitate the cable installing works.

A light source unit according to the present invention comprises: a plurality of light sources; and an electric component configuring a constant current supplying section that holds constant of current supplied to the plurality of light sources, wherein the electric component is arranged between the plurality of light sources.

According to an aspect of the present invention, it is possible to manufacture the light source unit to be thin, with properly arranging the plurality of light sources and the electric component configuring the constant current supplying section. As the electric component is arranged between the plurality of light sources, it is further possible to connect the electric component and the light source with an electric cable preventing across another electric cable, in the case that a power supply electric cable is connected to the electric component and the electric component is connected to respective light sources with the electric cable. Therefore, it is possible to reduce the length of the cable in the light source unit and to facilitate the cable installing works.

A light source unit according to the present invention comprises a support medium that supports the plurality of light sources and the electric component, wherein the support medium has a flat surface on which the plurality of light sources and the electric component are aligned.

According to an aspect of the present invention, it is possible to manufacture the light source unit to be thin because the plurality of light sources and the electric component are aligned on the flat surface of the support medium.

The light source unit according to the present invention comprises a connect section that is connected with power supply electric cables, wherein the connect section is arranged at the side where light is emitted from the plurality of light sources.

According to an aspect of the present invention, the connection section is connected with the power supply electric cables of the electric component and the connect section is arranged at the same side with the light emitted from the plurality of light sources. Assume the configuration of the light source unit that the support medium is a rectangular parallelepiped casing whose top surface is opened and that the plurality of light sources and the electric component are aligned on the bottom surface. In such the assumption, the electric cable is connected from the opened side of the light source unit or from the top portion of the side surface of the casing. As the results, it is possible to manufacture the light source unit to be thinner than the case of connecting from the bottom portion of the side surface of the casing. In the case that such the light source unit is applied to a product, such a lighting apparatus and a notice bearing apparatus, which is generally provided with a diffuser panel with a proper distance away from a light source for diffusing light emitted from the light source, the electric cable is positioned between the light source and the diffuser panel. Therefore, it is possible to manufacture the product such as the lighting apparatus and the notice bearing apparatus to be thin.

A light source unit according to the present invention has a distance held to be constant between each of the plurality of light sources and the electric component.

According to an aspect of the present invention, it is possible to facilitate not only the cable installing works between the light source units and but also the cable installing works within the light source unit, since the electric component is arranged at the position from which the distances to respective light sources are substantially equal with each other.

A light source unit according to the present invention comprises a thermally conductive sheet inserted between the support medium and the plurality of light sources and/or between the support medium and the electric component.

According to an aspect of the present invention, the thermally conductive sheet is inserted between the support medium and the plurality of light sources and/or between the support medium and the electric component, and then heat generated from a heat source such as the light source is efficiently conducted toward the support medium through the thermally conductive sheet. Therefore, it is possible to improve the heat dissipation and to utilize the light source having higher intensity. In the case that such the light source with higher intensity is applied to the product such as the lighting apparatus and the notice bearing apparatus, it is possible to save the number of light source units utilized for the product and then to facilitate the fixing works for light source units and the installing works for cables.

A light source unit according to the present invention has the support medium containing the plurality of light sources and the electric component, and a resin filled in the support medium, wherein the resin covers the plurality of light sources and the electric component.

According to an aspect of the present invention, it is possible to utilize the light source unit in the condition, such as outdoor, where the rain falls, since the resin is filled in the support medium and the resin covers the plurality of light sources and the electric component contained in the support medium.

A light source unit according to the present invention has the support medium provided with a partition member that partitions the plurality of light sources and the electric component.

According to an aspect of the present invention, it is possible to save the amount of filled resin for covering the plurality of light sources and the electric component, since the partition member is provided for partitioning the light sources and the electric component and the resin is filled into only the portion partitioned by the partition member.

The light source unit according to the present invention has the plurality of light sources that are serially connected.

According to an aspect of the present invention, it is possible to reduce the current amount more and to utilize the power supply electric cable thinner than the configuration arranging respective light sources connected in parallel, since the plurality of light sources are serially connected and the power supply voltage can be set properly in accordance with the power consumption of the light sources and the electric component. In the case of utilizing the electric cable having the same thickness, it is possible to connect larger numbers of light source units.

A light source unit according to the present invention has the light source configured with a plurality of LEDs that are connected in parallel.

According to an aspect of the present invention, it is possible to emit light even if one LED is failed and then to improve the reliability, since the light source is configured with the plurality of LEDs connected in parallel.

A lighting apparatus according to the present invention comprises the light source unit described above.

According to an aspect of the present invention, it is possible to manufacture the lighting apparatus to be thin, since the light source unit described above is applied to the lighting apparatus. Furthermore, it is possible to facilitate the fixing works for the light source unit applied into the lighting apparatus and the installing works for the cables.

A lighting apparatus according to the present invention comprises a diffuser panel that diffuses light emitted from the light source unit and is arranged to oppose the light source unit with a distance, wherein the light source unit arranges the light source with a substantially constant distance not more than the distance between the light source and the diffuser panel.

According to an aspect of the present invention, it is possible to make the plurality of light sources be recognized by a person as one light source surface where the emitted light are overlapped, but not as light source points, since light sources are arranged with a substantially the same distance not more than the distance between the light source and the diffuser panel. Thus, it is possible to prevent the person from feeling significant discomfort and annoyance. In addition, it is possible to obtain an optimal design of the lighting apparatus in consideration of the thin structure and the uniformity of the emitted light, since the distances between the light sources are held substantially the same with each other.

A notice bearing apparatus according to the present invention comprises the light source unit described above.

According to an aspect of the present invention, it is possible to manufacture the notice bearing apparatus to be thin, since the light source unit described above is applied to the notice bearing apparatus. Furthermore, it is possible to facilitate the fixing works for the light source unit applied into the notice bearing apparatus and the cable installing works for the cables.

A notice bearing apparatus comprises a casing that contains the light source unit, wherein the light source unit arranges the light source with a substantially constant distance in accordance with a shape of the casing.

According to an aspect of the present invention, it is possible to clearly show the shape of character and figure on the casing, since the light sources are arranged with a substantially the same distance along the shape of casing.

A notice bearing apparatus according to the present invention comprises a diffuser panel that diffuses light emitted from the light source unit and is arranged to oppose the light source unit with a distance in the casing, wherein the distance between the light sources is not more than the distance between the light source and the diffuser panel.

According to an aspect of the present invention, it is possible to make the plurality of light sources be recognized by a person as one light source surface where the emitted light are overlapped, but not as light source points, since light sources are arranged with a substantially the same distance not more than the distance between the light source and the diffuser panel. Thus, it is possible to prevent the person from feeling significant discomfort and further to clearly show the shape of character and figure on the casing by one emitting light surface.

In accordance with the present invention, it is possible to manufacture a light source unit to be thin, and to manufacture a lighting apparatus and a notice bearing apparatus utilizing the light source unit to be thin.

The above and further objects and features of the invention will more fully be apparent from the following detailed description with accompanying drawings.

DETAILED DESCRIPTION OF THE INVENTION

Hereinafter, the present invention is described in detail with reference to drawings illustrating embodiments according to the present invention.

(Embodiment 1)

Figure 1:
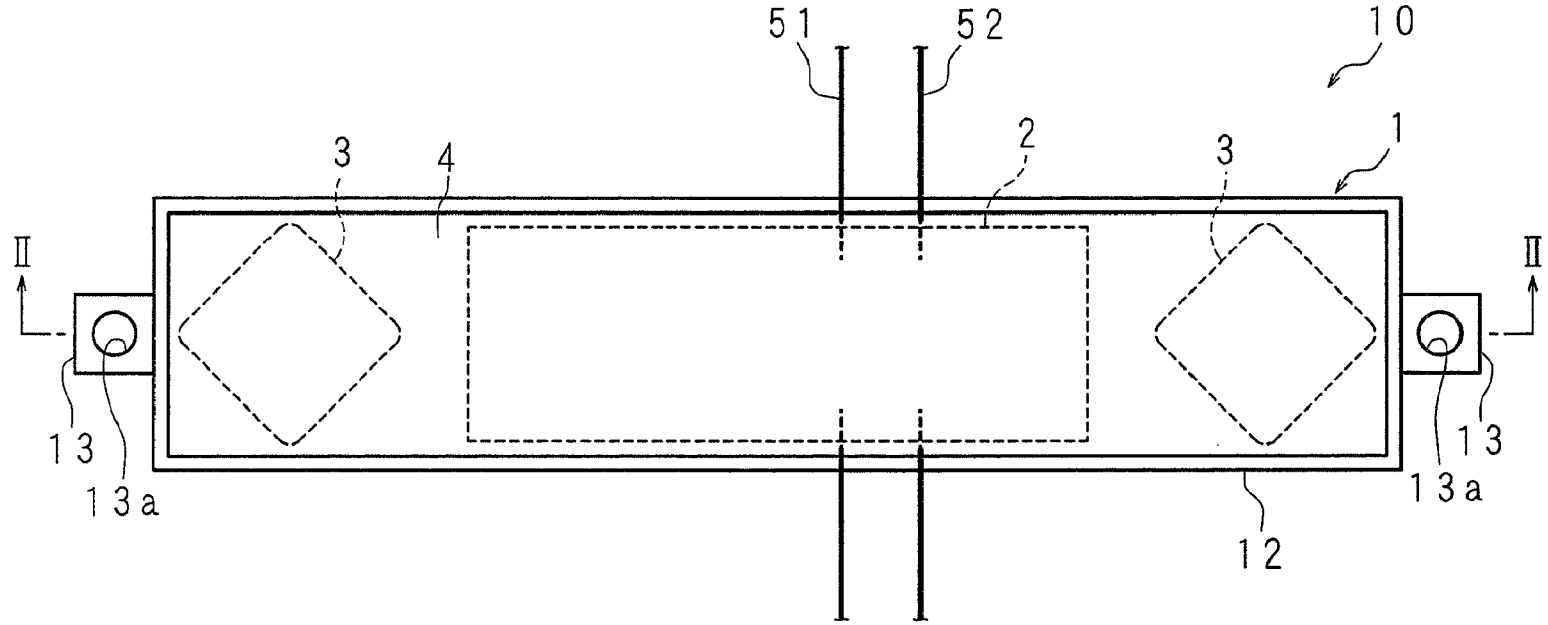
FIG. 1 is a schematic plane view illustrating a light source unit in an embodiment 1 according to the present invention.
Figure 2:
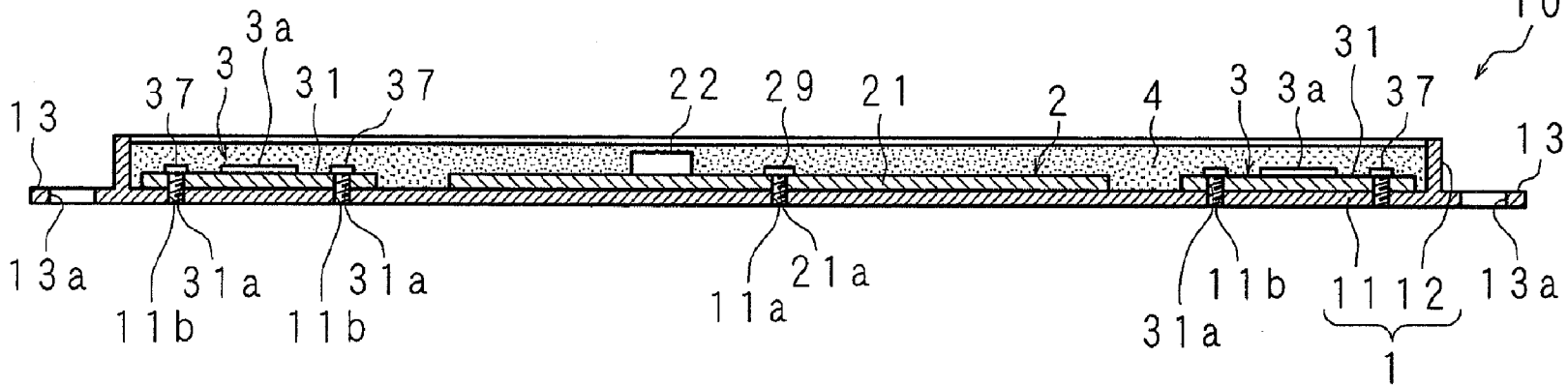
FIG. 2 is a schematic cross-sectional view through line II-II shown in FIG. 1.
Figure 3:
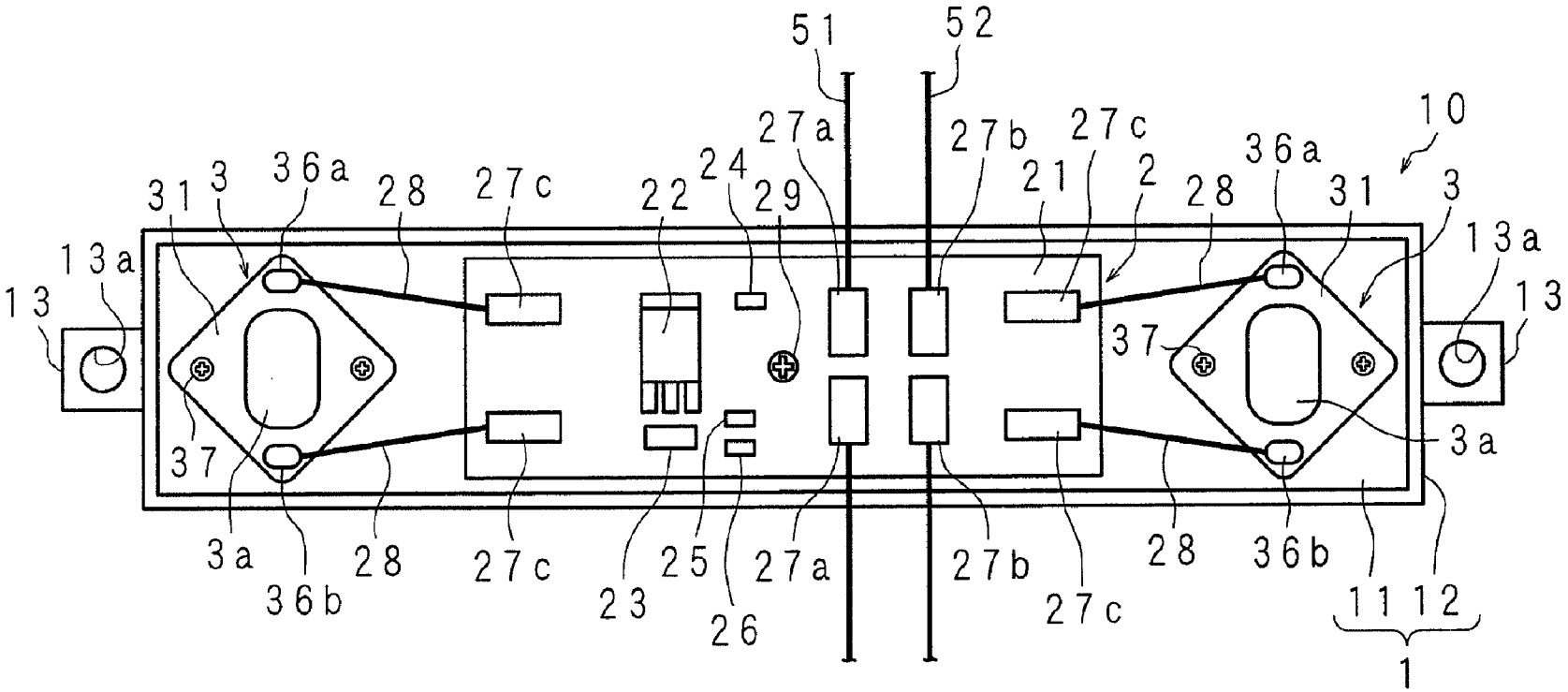
FIG. 3 is a schematic plane view illustrating the light source unit without resin to be filled.

FIG. 1 is a schematic plane view illustrating a light source unit 10 in an embodiment 1 according to the present invention. FIG. 2 is a schematic cross-sectional view through line shown in FIG. 1. FIG. 3 is a schematic plane view illustrating the light source unit 10 without resin to be filled, as the resin is described later.

In the figures, reference numeral "1" represents a module casing made of metal material, such as aluminum or copper, which has high thermal conductivity. The module casing 1 is configured with a rectangular plate 11 and a peripheral wall 12, as the peripheral wall 12 is installed vertically along the periphery of the rectangular plate 11. The module casing 1 is provided with two fixing portions 13, 13 at the both edges in the longitudinal direction, as each fixing portion 13 is formed in a rectangular plate shape and extends in the longitudinal direction along the longitudinal axis passing substantially the center of the module casing 1. The fixing portions 13, 13 have threaded holes 13*a*, 13*a*, respectively. In addition, the rectangular plate 11 of the module casing 1 is provided with a threaded hole 11 a at the center, and with threaded holes 11*b*, 11*b*, . . . at the end portions.

The module casing 1 is provided with a constant current supplying section 2 positioned substantially at the center on the upper surface of the rectangular plate 11. The constant current supplying section 2 is configured with a rectangular circuit board 21 made of epoxy resin on which a constant current supplying circuit and a protection circuit are mounted, as the constant current supplying circuit is configured with electric components such as a variable IC regulator 22 and a resistance 23 and the protection circuit is configured with electric components such as an electric fuse 24, a capacitor 25 and a varistor 26. Although the constant current supplying section 2 is configured with the constant current supplying circuit and the protection circuit in this embodiment, the constant current supplying section is enough to include at least one electric component configuring the constant current supplying circuit.

The circuit board 21 mounts two earth ground connecting terminals 27*a*, 27*a* in parallel in the latitudinal direction at the substantial center. Further, the circuit board 21 mounts two power connecting terminals 27*b*, 27*b* in parallel to the earth ground connecting terminals 27*a*, 27*a*. The earth ground connecting terminals 27*a*, 27*a* are connected to ground electric cables 51, 51, which are the power supply electric cables, from upper portions of the module casing 1, respectively. Similarly, the power connecting terminals 27*b*, 27*b* are connected to 24V power electric cables 52, 52, which are the power supply electric cables, from upper portions of the module casing 1, respectively. The circuit board 21 mounts respective two connecting terminals 27*c*, 27*c* at both end portions in the longitudinal direction. The connecting terminals 27*c*, 27*c*, . . . are connected to electric cables 28, 28, . . .

for supplying current to LED modules (light sources) described later, respectively. Furthermore, the circuit board 21 has a threaded hole 21*a* at the substantial center.

The circuit board 21 described above is fixed to the module casing 1 by a screw 29 threading into the threaded hole 21*a* at the center of the circuit board 21 and threading into the threaded hole 11*a* at the center of the rectangular plate 11 of the module casing 1. Between the circuit board 21 and the rectangular plate 11 of the module casing 1, a thermally conductive sheet (not shown) is inserted, as being made of material having high electric insulation property and high thermal conductivity, such as silicon resin.

Figure 4:
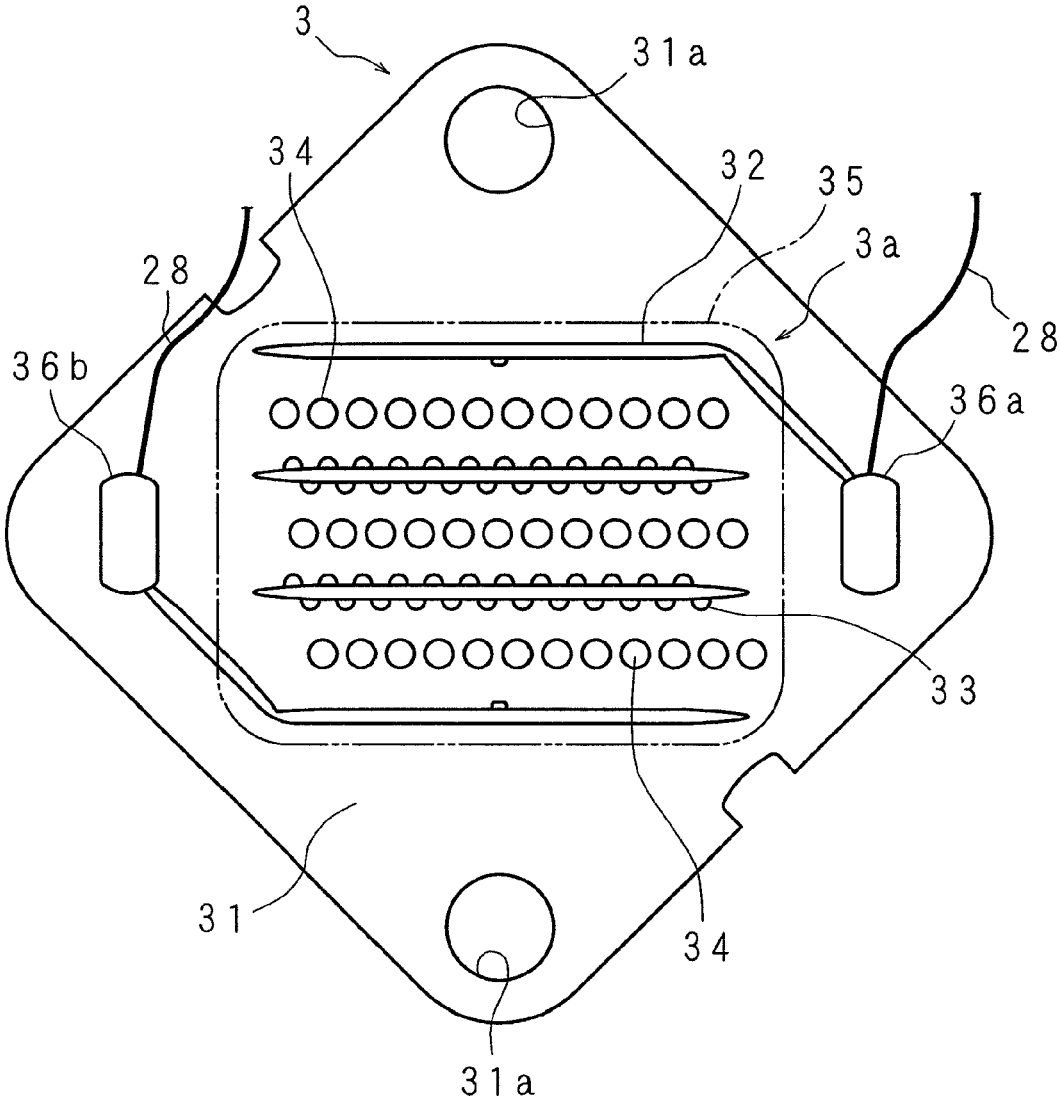
FIG. 4 is a schematic plane view illustrating a LED module.

The LED modules 3, 3 are arranged separately with a proper distance at both end portions of the rectangular plate 11 of the module casing 1 in the longitudinal direction and on the upper surface of the rectangular plate 11 of the module casing 1, respectively. The both end portions are symmetrically positioned about the circuit board 21, and each of the LED modules 3, 3 is formed in a square shape. In this embodiment, one LED module 3 is arranged about 10 cm away from another LED module 3. FIG. 4 is a schematic plane view illustrating the LED module 3 reference numeral "31" in the figure represents a LED board made of ceramic, such as aluminum oxide (alumina). The LED board 31 is formed in a square shape, and provided with two threaded holes 31*a*, 31*a* at the opposing two corners.

The LED board 31 is provided with a wiring pattern 32 at the center area, and the wiring pattern 32 is formed in parallel, for example, by a photo-etching technique. The LED board 31 is provided with a LED mounting guide mark 33 positioned along the wiring pattern 32, and with a plurality of blue LEDs (for example, 36 numbers) 34, 34, . . . that are in parallel three-row configuration and fixed with resin such as the epoxy resin.

These LEDs 34, 34, . . . are connected to the wiring pattern 32 with wires (not shown), for example, in the configuration to be 12 rows connected in parallel, each of which consists of three LEDs 34, 34, . . . that are serially connected. The LED board 31 is interiorly provided with a reflective layer (not shown) that reflects light, as the reflective layer is formed by a sputtering technique. Thus, the reflective layer reflects the light passing into the LED board 31 from the LEDs 34, 34, . . . .

The plurality of LEDs 34, 34, . . . mounted as described above are covered and sealed by sealant resin 35, such as the epoxy resin, which dispersedly contains yellow luminescent material that is excited by the light emitted from the LEDs 34, 34, . . . and then luminesces in yellow. The LED module 3 has a light emitting part 3*a* configured with these LEDs 34, 34, . . . and the sealant resin 35 dispersedly containing yellow luminescent material.

The LED board 31 is provided with an input terminal 36*a* and an output terminal 36*b* at the other opposing two corners. The input terminal 36*a* and the output terminal 36*b* of the LED board 31 are connected to the connecting terminals 27*c*, 27*c* of the circuit board 21 with the electric cables 28, 28, respectively. The LED modules 3, 3 are connected serially with each other.

The LED modules 3, 3, described above are fixed to the module casing 1 by screws 37, 37, . . . threading into the threaded holes 31*a*, 31*a*, . . . formed on the LED boards 31, 31 of the LED modules 3, 3 and threading into the threaded holes 11*b*, 11*b*, . . . formed on the rectangular plate 11 of the module casing 1, respectively. Between each of the LED boards 31, 31 and the rectangular plate 11, a thermally conductive sheet (not shown) is disposed, as being made of material having high electric insulation property and high thermal conductivity, such as silicon resin.

As interiorly mounting the constant current supplying section 2 and the LED modules 3, 3, the module casing 1 is filled with transparent resin 4 having high water proofing property, and the constant current supplying section 2 and the LED modules 3, 3 are covered by the resin 4 as shown in FIG. 2. The resin 4 consists of, for example, silicon.

Figure 5:
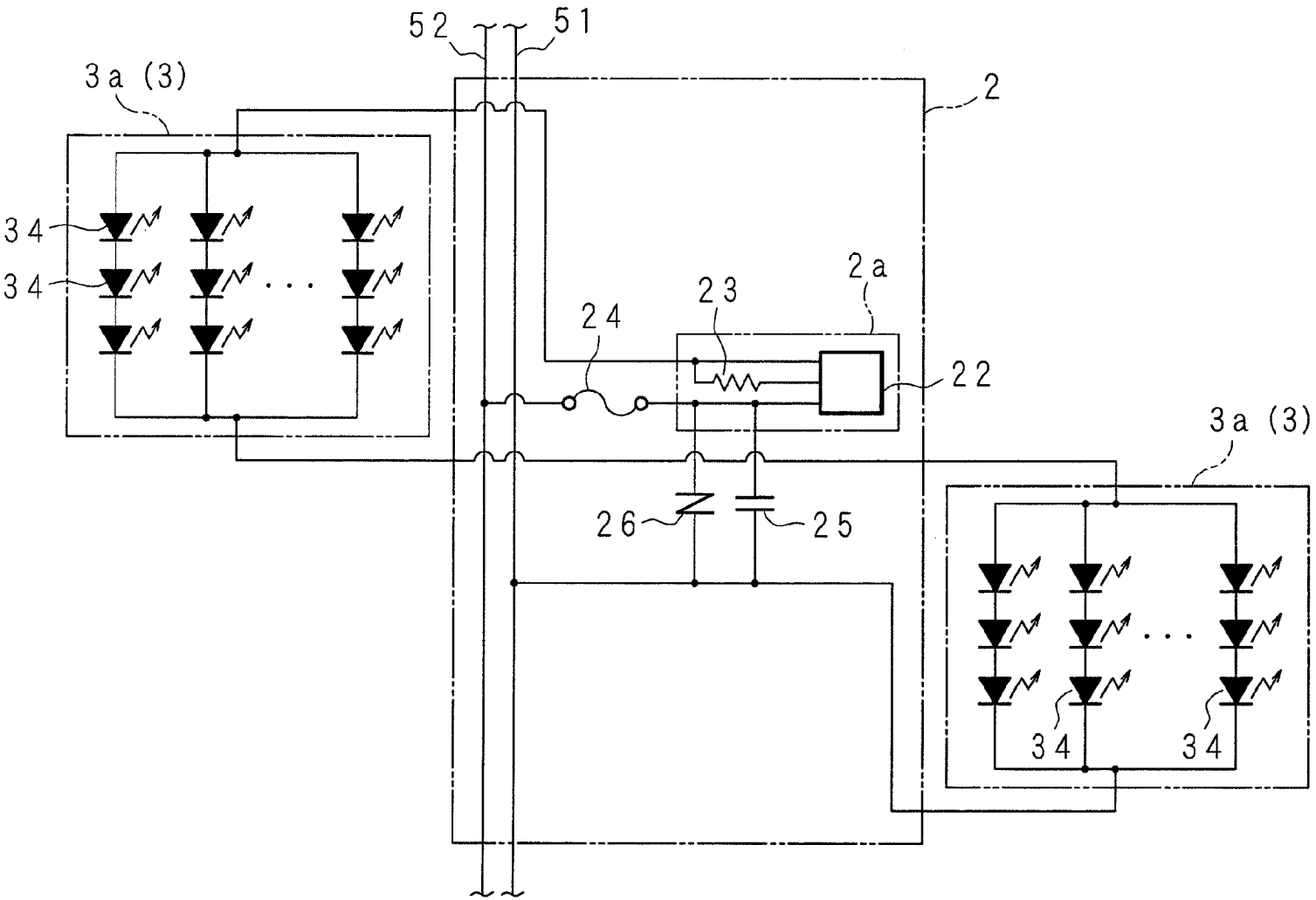
FIG. 5 is an electric circuit diagram of the light source unit according to the embodiment 1.

FIG. 5 is an electric circuit diagram of the light source unit 10 according to the embodiment 1. The 24V power electric cable 52 is connected to a power circuit section (not shown). The 24V power electric cable 52 is supplied with 24V power voltage that the power circuit section has already rectified the AC current supplied from the external power source to be the DC current. In this embodiment, the forward voltage of each LED module 3 is 10.6 V. The "24V" of the supplied power voltage is set in consideration of the "21.2V" due to two forward voltages of LED modules 3, 3 connected serially and the voltage drop due to the constant current supplying section 2 and the electric cable 52.

The 24V power electric cable 52 is connected to one end of the electric fuse 24. Since the electric fuse 24 is promptly fused open in response to generated current surge, it is possible to prevent the electric circuit from smoking and firing. The other end of the electric fuse 24 is connected to one end of the constant current supplying circuit 2*a* configured with the variable IC regulator 22 having three terminals and the resistance 23. The variable IC regulator 22 having three terminals is controlled to hold constant voltage between own output terminal and own adjustment terminal. Thus, the output voltage is adjusted in order to keep the constant current amount depending on the resistant value of the resistance 23.

The other end of the constant current supplying circuit 2*a* is connected to one end of the light emitting part 3*a* of one LED module 3. The other end of the light emitting part 3*a* of this LED module 3 is connected to one end of the light emitting part 3*a* of the other LED module 3. The other end of the light emitting part 3*a* of said other LED module 3 is connected to the ground electric cable 51. Anyway, the other end of the electric fuse 24 is connected to one end of the capacitor 25 and to one end of the varistor 26. The other end of the capacitor 25 and the other end of the varistor 26 are connected to the ground electric cable 51. The capacitor 25 is a so-called bypass capacitor, and removes noises having the high frequency component. The varistor 26 changes own resistant value with response to voltage over a predetermined amount, and then allows sending current. Thus, the varistor 26 contributes in absorbing abnormal over voltage. Therefore, it is possible to absorb noises, to prevent causing malfunctions, and to prevent the electric components from being broken, for protecting the electric circuit.

When the light source unit 10 described above is switched on, the DC current is rectified and supplied to the light source unit 10 from the power circuit section. The supplied current is adjusted to have a constant current amount by the constant current supplying section 2, and then applied to the light emitting parts 3*a*, 3*a* that are serially connected with each other. Thus, the light emitting parts 3*a*, 3*a* stably emit light having substantially the same brightness with each other.

Since the constant current supplying section 2 is arranged within the light source unit 10, it is possible to stably supply the current having the constant amount to the LEDs 34, 34, . . . , and to prevent the variations in brightness. Since the plurality of LED modules 3, 3 and the constant current supplying section 2 are aligned on the upper surface of the rectangular plate 11 of the module casing 1, it is possible to manufacture the light source unit 10 to be thin.

As described above, the LED modules 3, 3 are configured in high intensity with a plurality of blue LEDs (e.g., 36 numbers) 34, 34, . . . that are densified and mounted on the LED board 31 and utilized as the light sources. Thus, even in the case that each LED module 3 is arranged about 10 cm away from another LED module 3 as described in this embodiment, it is possible to obtain proper brightness. Furthermore, it is possible to effectively utilize the space between the LED modules 3, 3 within the light source unit 10 for arranging electric components, such as the variable IC regulator 22, the resistance 23, the electric fuse 24, the capacitor 25 and the varistor 26 that are configuring the constant current supplying section 2. Therefore, it is possible for a product, such as a lighting apparatus and a notice bearing apparatus, to effectively emit light with utilizing a small number of light sources which are applied to the product.

Since the constant current supplying section 2 and the LED modules 3, 3 are aligned on the rectangular plate 11 of the module casing 1 to make the constant current supplying section 2 position between the LED modules 3, 3, respective LED modules 3, 3 can be connected to the constant current supplying section 2 with the electric cables 28, 28, . . . without crossing over the connection of another LED module. Therefore, it is possible to shorten the cable length within the light source unit 10 and to facilitate the cable installing works. Since the constant current supplying section 2 is positioned away substantially the same distance from both the plurality of LED modules 3, 3, it is possible to facilitate the cable installing works between the light source units 10, 10, . . . for connecting the plurality of light source units 10, 10, . . . , and to facilitate the cable installing works within each light source unit 10.

For example, in the case that both the ground electric cable 51 and the 24V power electric cable 52 are connected through the bottom portions of the peripheral walls 12 of the module casing 1, a space is required between the circuit board 21 and the rectangular plate 11 of the module casing 1. However, this embodiment connects both the ground electric cable 51 and the 24V power electric cable 52 through the top portions of the module casing 1 to the constant current supplying section 2. Therefore, it is possible in the embodiment to manufacture the light source unit 10 to be thin.

Since the thermally conductive sheets are inserted between the module casing 1 and the constant current supplying section 2 and between the module casing 1 and the plurality of LEDs 3, 3 to effectively conduct the heat generated by the heat sources such as the LED modules 3, 3 through the thermally conductive sheet toward the module casing 1, it is possible to improve the heat dissipation property as well as to utilize the high intensity LED. In the case that the high intensity LED is applied to the light source unit 10 and such the light source unit 10 is applied to the product, such as the lighting apparatus and the notice bearing apparatus, it is possible to reduce the number of the light source unit 10 required for the product and to facilitate the installing works of the light source unit 10 and the cable.

Since the resin 4 such as the silicon resin is filled in the module casing 1 to cover the plurality of LED modules 3, 3 and the constant current supplying section 2 arranged within the module casing 1, it is possible to utilize the light source unit 10 even under the condition, such as outdoor, where the rain falls.

The plurality of LED modules 3, 3 are serially connected with each other, and the power voltage supplied to the light source unit 10 is set to be 24V in consideration of the 21.4 V obtained by the adding calculation of the forward voltages of the serially connected LED modules 3, 3 and of the voltage drop due to the constant current supplying section 2 and the electric cable 52. Therefore, it is possible to save the required current amount and to make the electric cables thinner, in comparison with the case that the LED modules 3, 3 are connected in parallel. In the case of utilizing the electric cable having the same thickness, it is possible to connect a larger number of light source units.

Since the LED module 3 is configured with the plurality of LEDs 34, 34, . . . connected in parallel, the light source unit 10 can emit light even if one LED 34 is in failure. Therefore, it is possible to improve the reliability of the light source unit 10.

Figure 6:
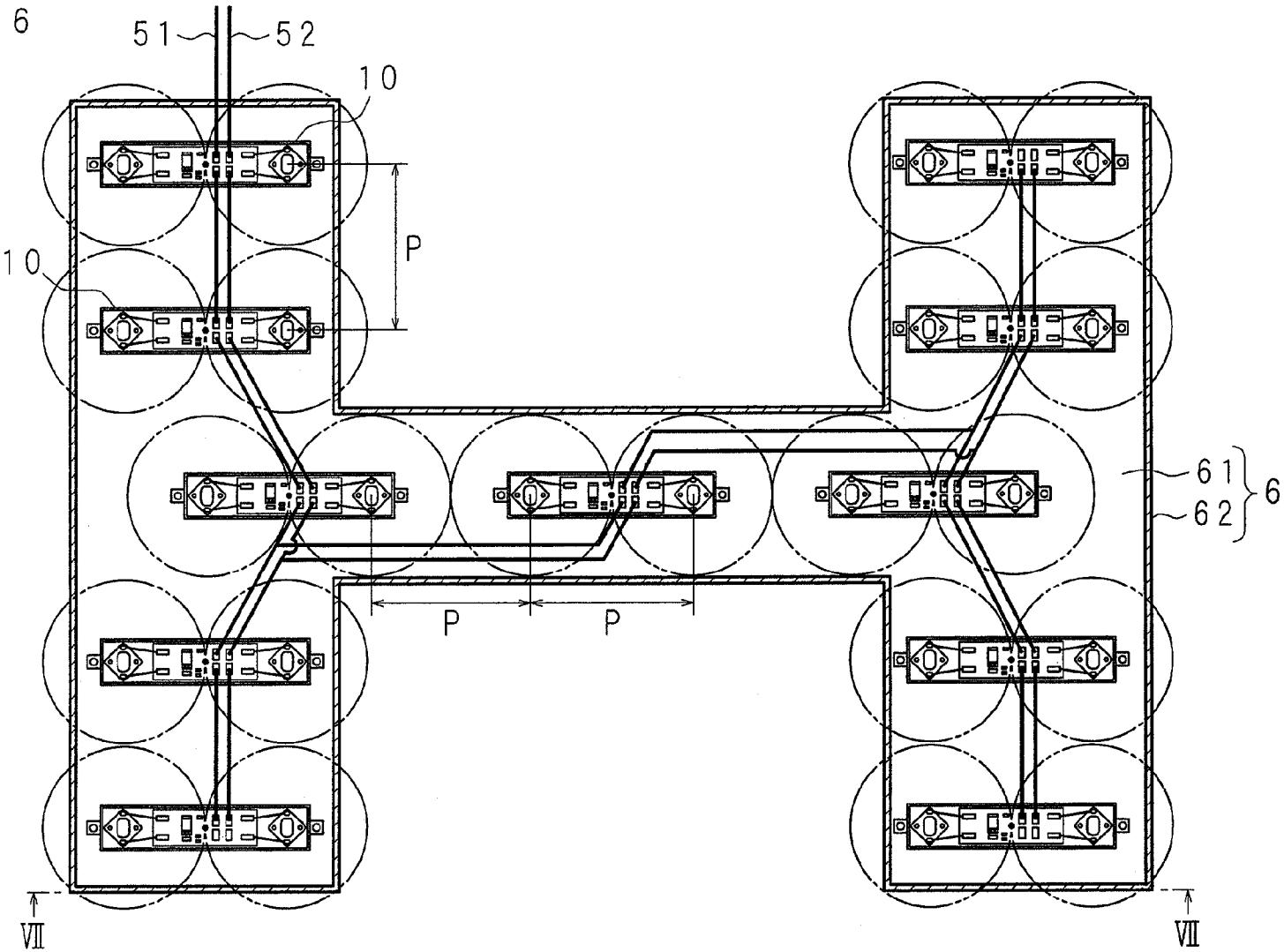
FIG. 6 is a schematic cross-sectional view of a signboard including the light source unit according to the embodiment 1.
Figure 7:
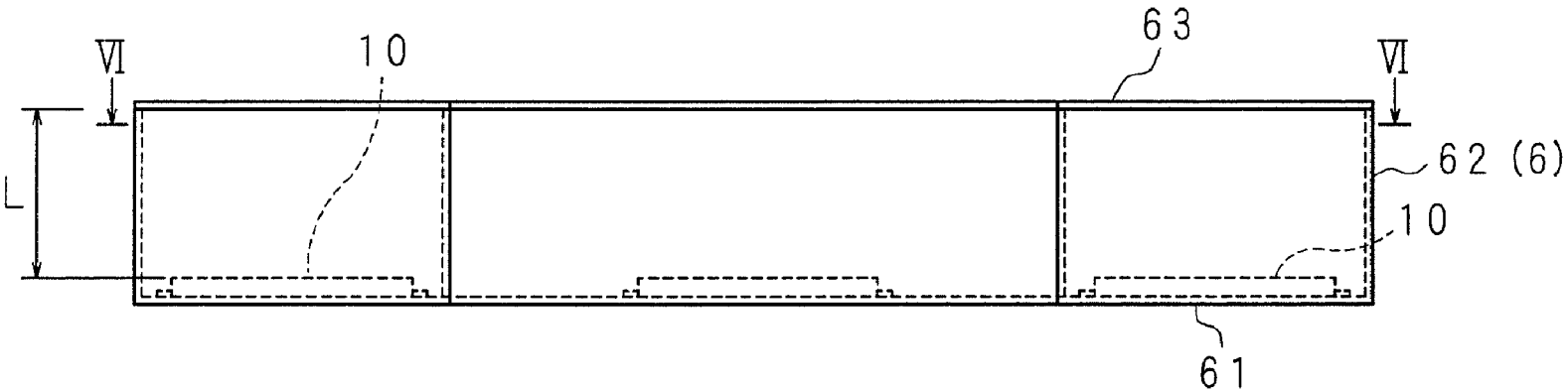
FIG. 7 is a schematic side view through line VII-VII shown in FIG. 6.

Such the light source unit 10 can be applied to the product, such as the lighting apparatus and the notice bearing apparatus. FIG. 6 is a schematic cross-sectional view of a signboard including the light source unit 10 according to the embodiment 1. FIG. 7 is a schematic side view through line VII-VII shown in FIG. 6. The signboard shown in FIG. 6 and FIG. 7 is an example of interiorly illuminating signboard that illuminates with light emitted from a light source arranged behind the transparent material to display the shape, such as a character and a figure.

Reference numeral "6" in the figure represents a signboard casing made of metal material, such as aluminum and stainless steel. The signboard casing 6 is configured with a plate 61 formed in the "H" shape and a peripheral wall 62 installed vertically along the periphery of the plate 61.

The plurality of light source units 10, 10, . . . are arranged on the plate 61 of the signboard casing 6 as shown in FIG. 6, and adjacent light emitting parts 3*a*, 3*a* are positioned substantially the same distance "P" away from each other. The light source unit 10 is fixed to the signboard casing 6 by screws threading into the threaded holes 13*a*, 13*a* formed on the fixing portions 13, 13 of the module casing 1 and threading into a threaded hole (not shown) of the plate 61 of the signboard casing 6. Both the ground electric cable 51 and the 24V power electric cable 52 are connected between the light source units 10, 10, . . . , and the light source units 10, 10, . . . are connected in parallel. In the figure, an alternate long and two short dashes line is utilized for illustrating an imaginary circle having a diameter "P" whose center is the light emitting part 3*a* of each of the light source units 10, 10, . . . arranged as described above. As shown in the figure, the imaginary circles are arranged to contact with each other along the "H" shape. Therefore, when the light emitting parts 3*a*, 3*a*, . . . illuminate, the character "H" is clearly displayed with substantially the same brightness on whole area of the character "H".

The signboard casing 6 is provided with a diffuser panel 63 at the open side, as the plate 61 has substantially the same shape as the plate 61. The diffuser panel 63 is made of semi-opaque acrylic resin which has the reflectance rate substantially the same as the transmittance rate. Since the sunlight is reflected by the diffuser panel 63, the signboard can be prominently visible even during bright daytime.

The height of the peripheral wall 62 is configured to make a distance "L" between the diffuser panel 63 and the light source unit 10 be substantially the same as the distance "P" between the light emitting parts 3*a*, 3*a*, . . . (i.e., $L \approx P$). The reason is following. The distance "P" between the light emitting parts 3*a*, 3*a*, . . . is preferred to be not more than the distance "L" between the diffuser panel 63 and the upper surfaces (particularly, light emitting surfaces of the emitting parts 3*a*, 3*a*, . . . ) of the light source units 10, 10, . . . (i.e., $P \leqq L$), in order to make a person recognize the overlaid light emitted from the plurality of the emitting parts 3*a*, 3*a* as one light emitting surface but not as distinct light emitting portions, and in order to clearly show the character on the one light emitting surface. Further, the distance "L" between the diffuser panel 63 between the light source units 10, 10, . . . is preferred to be shorter in order to manufacture the thinner signboard. Furthermore, the light emitting parts 3*a*, 3*a*, . . . are preferably arranged with a proper distance away from each other, in order to save the consumption power and to obtain proper brightness. In other words, the distance "P" between the light emitting parts 3*a*, 3*a*, . . . is preferred to be about 10 cm and further the distance "L" between the diffuser panel 63 and the light source units 10, 10, . . . is preferred to be about 10 cm.

Since the distances between the LED modules 3, 3, . . . are substantially the same with each other as described above, it is possible to obtain the best design of the signboard in consideration of the thinner body and obtain the prevention of variations in the emitted light. Since the distance "P" between the light emitting parts 3*a*, 3*a*, . . . is configured to be not more than the distance "L" between the diffuser panel 63 and the light source units 10, 10, . . . , it is possible to make a person visually recognize the plurality of light emitting parts 3*a*, 3*a*, . . . as one overlaid light source surface, but not as some light source points. Therefore, it is possible not only to prevent the person from feeling significant discomfort but also to make the one emitting light surface clearly display the shape, such as the character and the figure, shown by the signboard casing 6.

As shown in FIG. 6, both the ground electric cable 51 and the 24V power electric cable 52 are connected between the light source units 10, 10 . . . . Particularly, these electric cables 51, 52 are positioned between the diffuser panel 63 and the light source units 10, 10, . . . . Therefore, it is possible to manufacture the signboard to be thinner.

Figure 8:
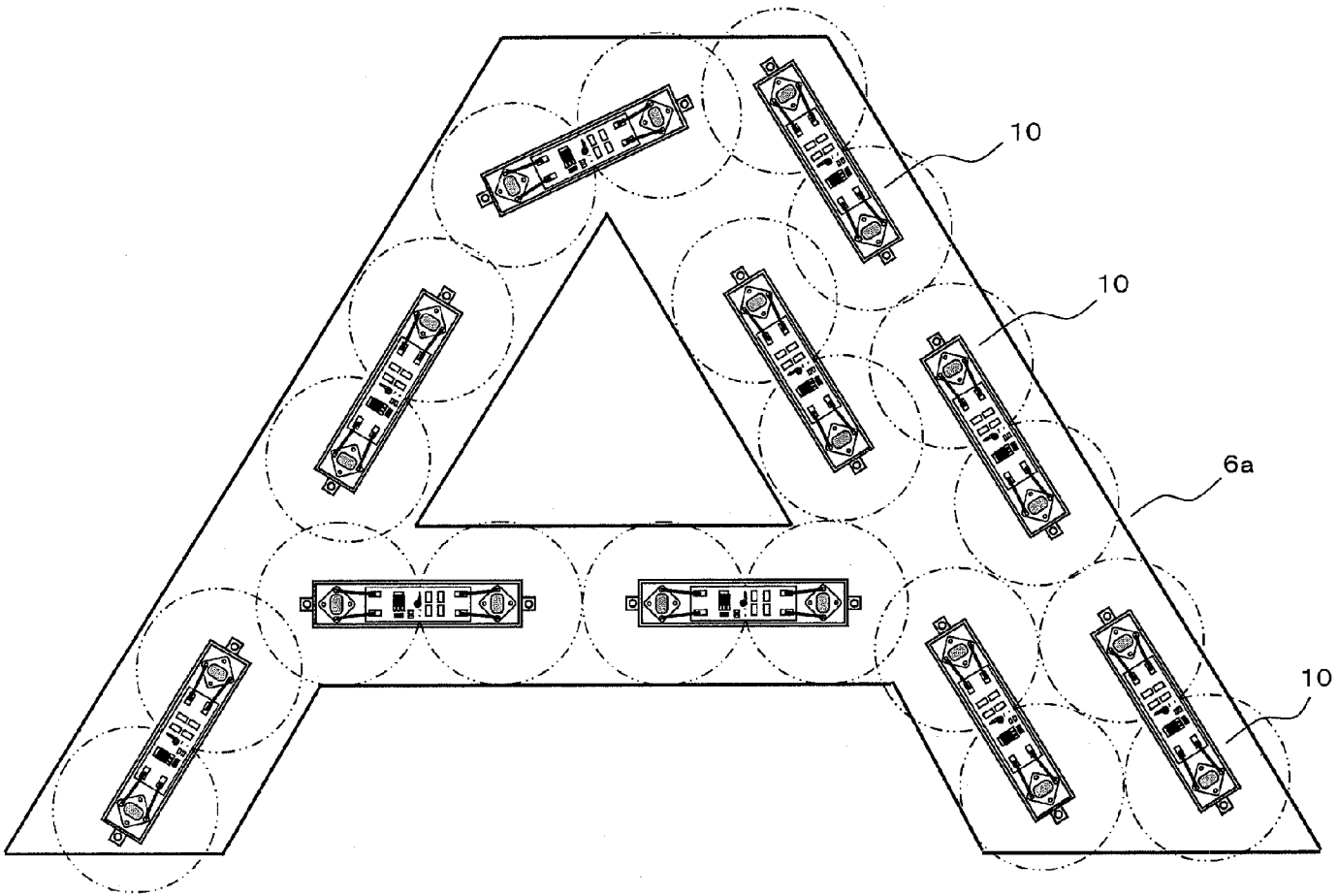
FIG. 8 is a view illustrating another arrangement example of the light source unit according to the embodiment 1.
Figure 9:
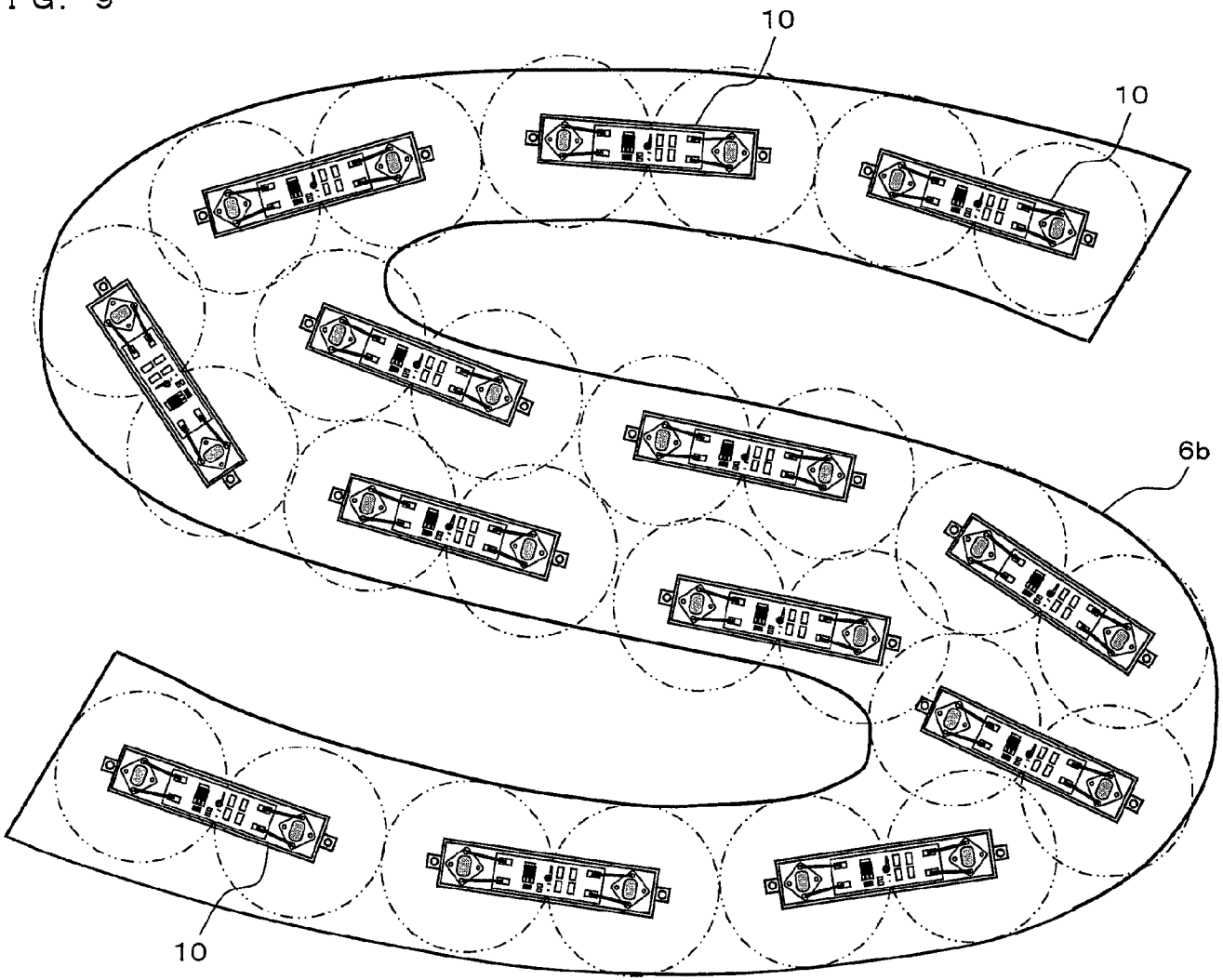
FIG. 9 is a view illustrating another arrangement example of the light source unit according to the embodiment 1.

FIG. 8, as well as FIG. 9, is a view illustrating another arrangement example of the light source unit according to the embodiment 1. In FIG. 8, the signboard casing 6*a* is formed in the "A" shape, and the plurality of light source units 10, 10, . . . are arranged to make adjacent light emitting parts 3*a*, 3*a* position substantially the same distance "P" away from each other. In the figure, an alternate long and two short dashes line is utilized for illustrating an imaginary circle having a diameter "P" whose center is the light emitting part 3*a* of each of the light source units 10, 10, . . . . As shown in the figure, the imaginary circles are arranged to contact with each other along the "A" shape. Therefore, when the light emitting parts 3*a*, 3*a*, . . . illuminate, the character "A" is clearly displayed with substantially the same brightness on whole area of the character "A".

In FIG. 9, the signboard casing 6*b* is formed in the "S" shape, and the plurality of light source units 10, 10, . . . are arranged to make adjacent light emitting parts 3*a*, 3*a* position substantially the same distance "P" away from each other. In the figure, an alternate long and two short dashes line is utilized for illustrating an imaginary circle having a diameter "P" whose center is the light emitting part 3*a* of each of the light source units 10, 10, . . . . As shown in the figure, the imaginary circles are arranged to contact with each other along the "S" shape. Therefore, when the light emitting parts 3*a*, 3*a*, . . . illuminate, the character "S" is clearly displayed with substantially the same brightness on whole area of the character "S".

The utilization of the light source unit 10 according to the embodiment 1 as described above can implement arranging the light source units 10, 10, . . . to make the light emitting parts 3*a*, 3*a* position with substantially the same distance away from each other in the signboard having the curving shape like a character. Therefore, it is possible to clearly illuminate the signboard with substantially the same brightness on whole area of the signboard.

(Embodiment 2)

Figure 10:
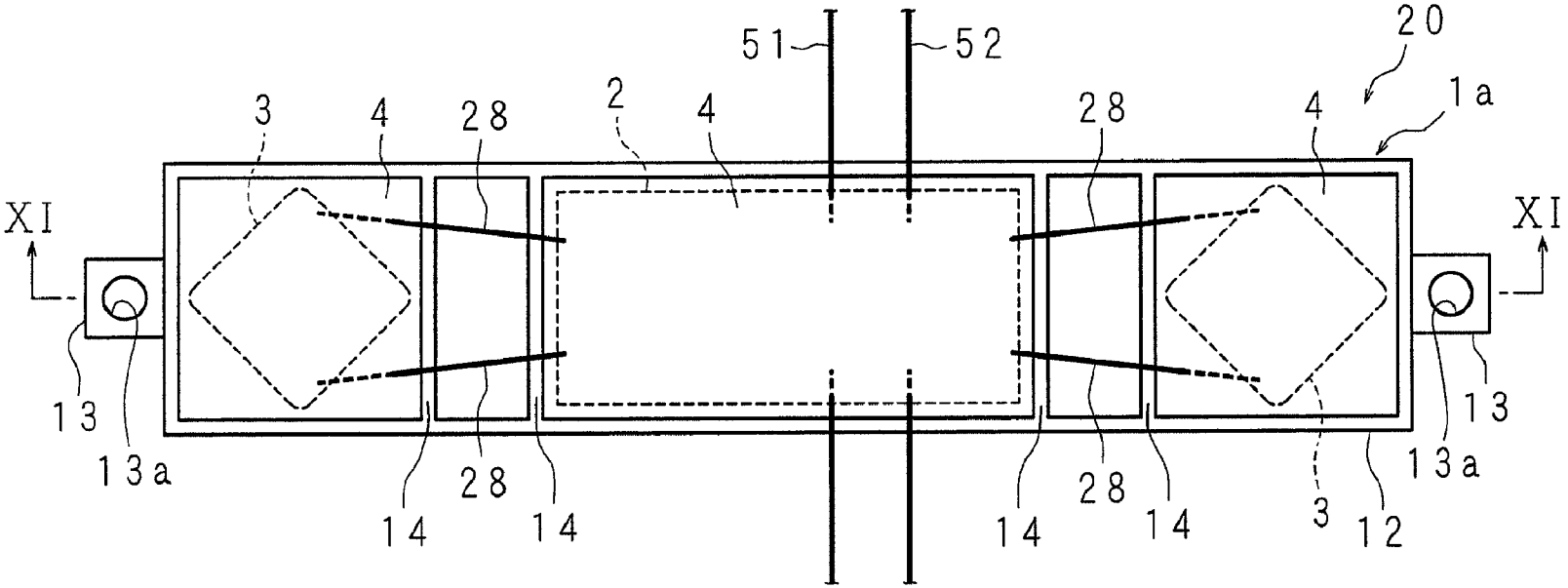
FIG. 10 is a schematic plane view illustrating a light source unit in an embodiment 2 according to the present invention.
Figure 11:
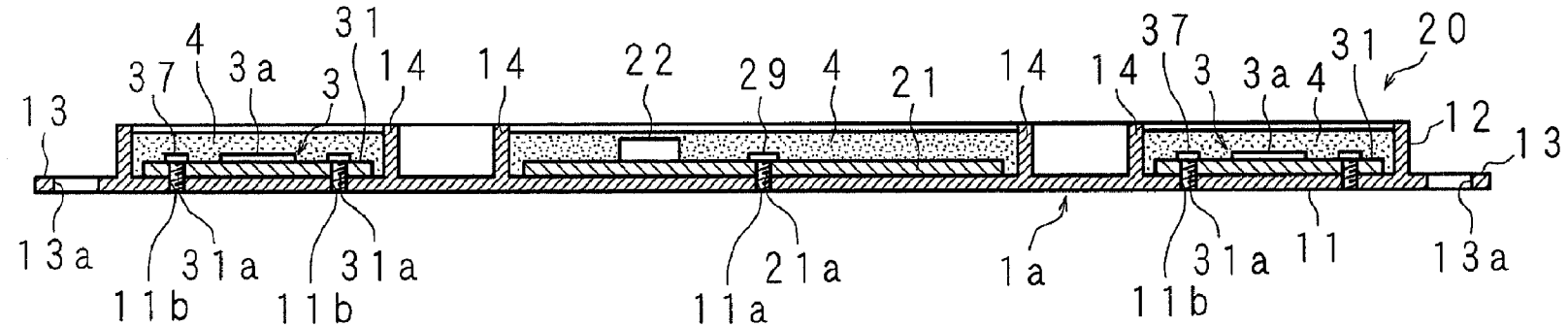
FIG. 11 is a schematic cross-sectional view through line XI-XI shown in FIG. 10.
Figure 12:
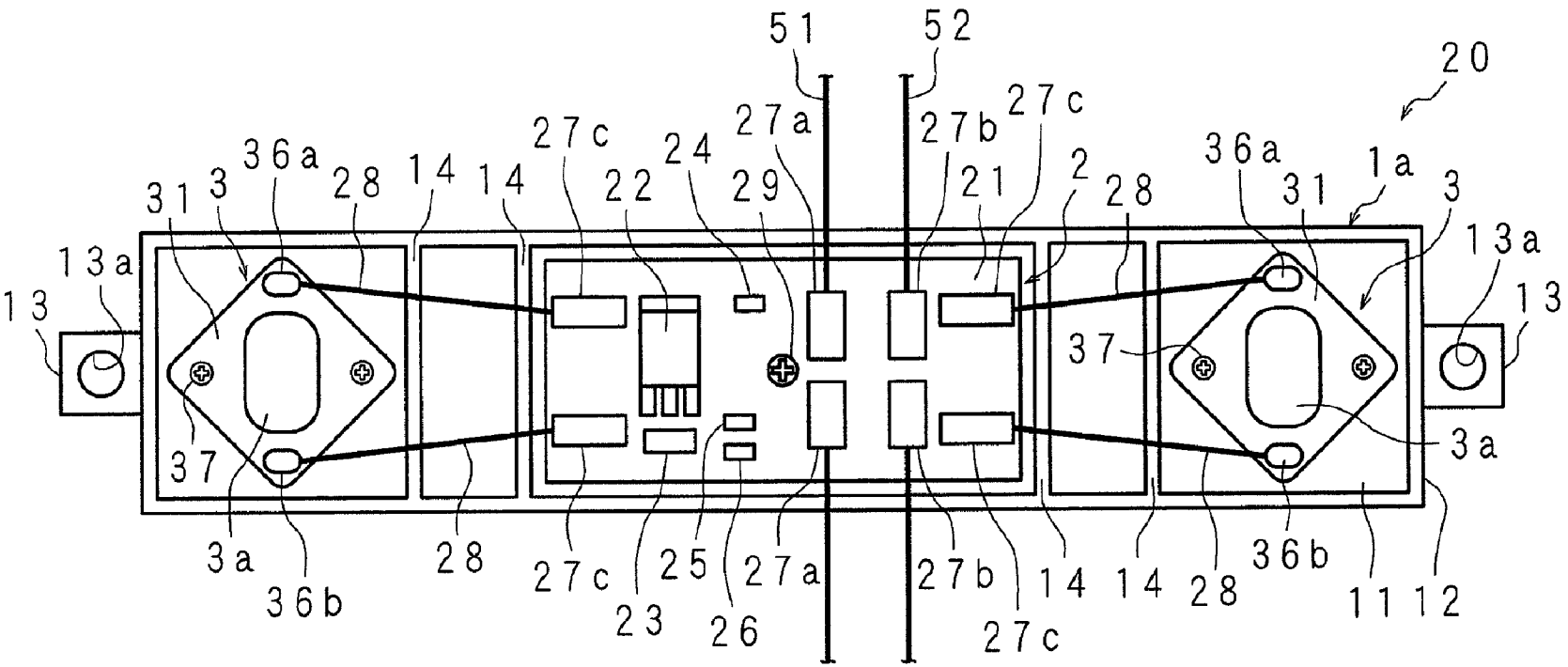
FIG. 12 is a schematic plane view illustrating the light source unit without resin to be filled.

FIG. 10 is a schematic plane view illustrating a light source unit 20 in an embodiment 2 according to the present invention. FIG. 11 is a schematic cross-sectional view through line XI-XI shown in FIG. 10. FIG. 12 is a schematic plane view illustrating the light source unit 20 without resin to be filled.

In the figure, reference numeral "1*a*" represents a module casing made of metal material, such as aluminum or copper, which has high thermal conductivity. The module casing 1*a* is configured with the rectangular plate 11, the peripheral wall 12 and a plurality of partition plates 14, 14, . . ., as the peripheral wall 12 is installed vertically along the periphery of the rectangular plate 11 and the partition plates 14, 14, . . . are installed vertically on the rectangular plate 11 . As shown in the figure, the partition plates 14, 14, . . . are installed to partition respective of the LED modules 3, 3, and the contact current supplying section 2.

As shown in FIG. 10 and FIG. 11, the resin 4 is filled within the portions partitioned by the partition plates 14, 14, . . . in the module casing 1*a*. The resin 4 is transparent material having high water proofing property and covers the constant current supplying section 2 and the LED modules 3, 3. The other configurations of this embodiment are similar to those of the embodiment 1 shown in FIG. 1, FIG. 2 and FIG. 3. Thus, such the similar configuration elements are given the same reference numerals as the corresponding configuration elements shown in FIG. 1, FIG. 2 and FIG. 3, and then omitted the detailed explanations.

The light source unit 20 according to the embodiment is provided with the partition plates 14, 14, . . . that partition respective of the plurality of LED modules 3, 3 and the constant current supplying section 2, and the resin 4 filled only in the portions participated by the partition plates 14, 14, . . . . Therefore, it is possible to save the amount of filled resin 4 required for covering the LED modules 3, 3 and the constant current supplying section 2.

(Embodiment 3)

Figure 13:
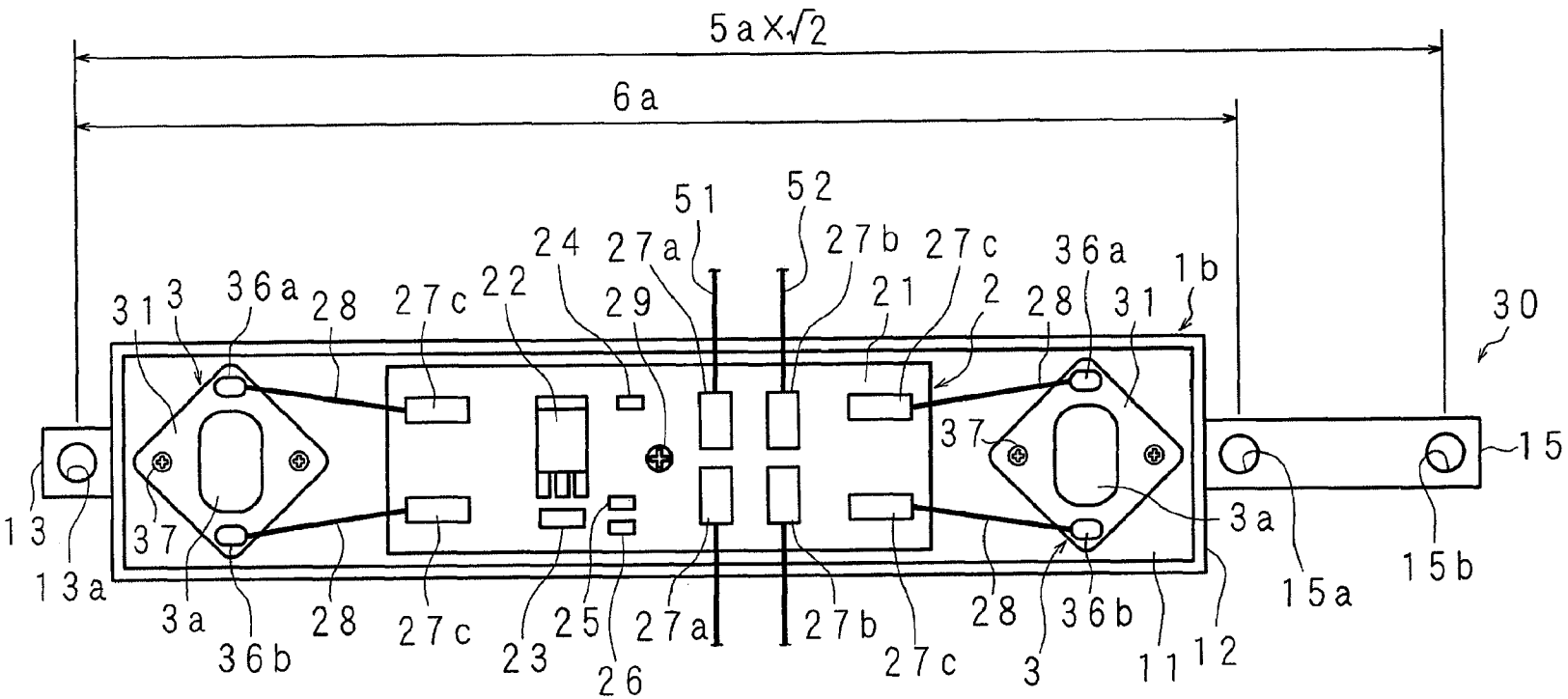
FIG. 13 is a schematic plane view illustrating a light source unit in an embodiment 3 according to the present invention.

FIG. 13 is a schematic plane view illustrating a light source unit 30 in an embodiment 3 according to the present invention. It should be noted that the resin is not filled in FIG. 13 for illustration purpose.

In the figure, reference numeral "1*b*" represents a module casing made of metal material, such as aluminum or copper, which has high thermal conductivity. The module casing 1*b* is configured with the rectangular plate 11 and the peripheral wall 12, as the peripheral wall 12 is installed vertically along the periphery of the rectangular plate 11. The module casing 1*b* is provided with the fixing portion 13 at the one edge in the longitudinal direction, as the fixing portion 13 is formed in a substantial square shape and extends in the longitudinal direction along the longitudinal axis passing substantially the center of the module casing 1*b*. The fixing portion 13 has the threaded hole 13*a*. The module casing lb is provided with a fixing portion 15 at the other edge in the longitudinal direction, as the fixing portion 15 is formed in an oblong rectangular plate shape and extends in the longitudinal direction along the longitudinal axis passing substantially the center of the module casing 1*b*. The fixing portion 15 has two threaded holes 15*a*, 15*b*.

These two threaded holes 15*a*, 15*b* of the fixing portion 15 are configured to be the distance "6×a" (a: variable number) between the threaded hole 13*a* of the fixing portion 13 and the threaded hole 15*a* of the fixing portion 15 closer to the module casing 1*b* in comparison with the other threaded hole 15*b*, and to be the distance "$5\times a\times(2)^{0.5}$" between the threaded hole 13*a* of the fixing portion 13 and the threaded hole 15*b* of the fixing portion 15 far to the module casing 1*b* in comparison with the other threaded hole 15*a*. The other configurations of this embodiment are similar to those of the embodiment 1 shown in FIG. 3. Thus, such the similar configuration elements are given the same numerals as the corresponding configuration elements shown in FIG. 3, and then omitted the detailed explanations.

Figure 14A:
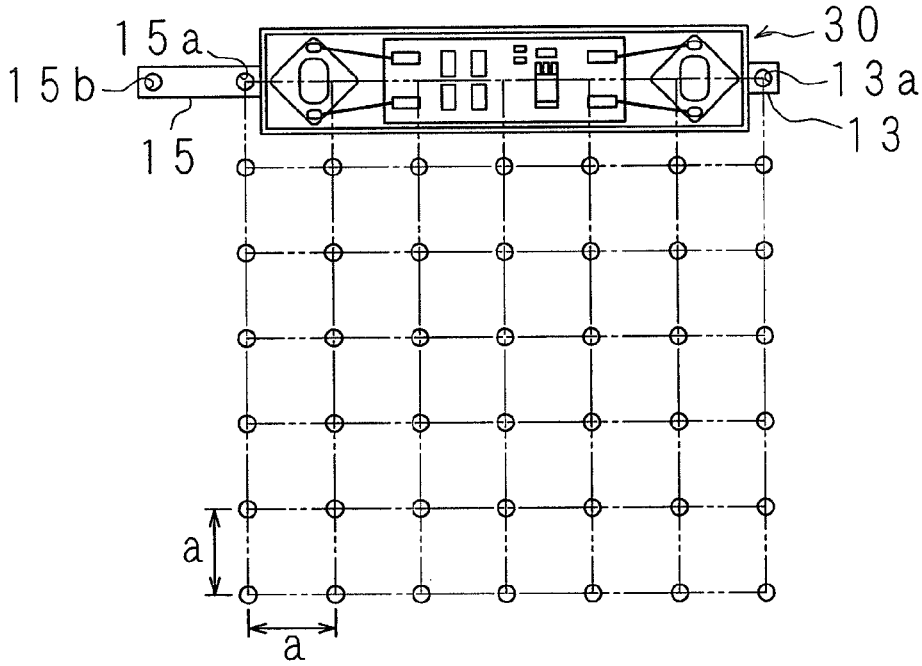
FIG. 14A is a conceptual view explaining a fixing method of the light source unit.
Figure 14B:
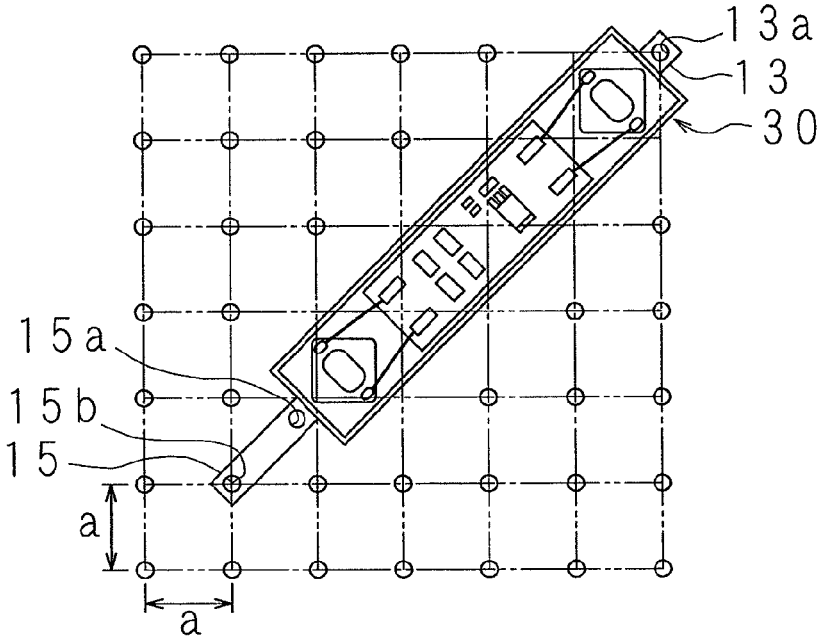
FIG. 14B is a conceptual view explaining a fixing method of the light source unit.
Figure 14C:
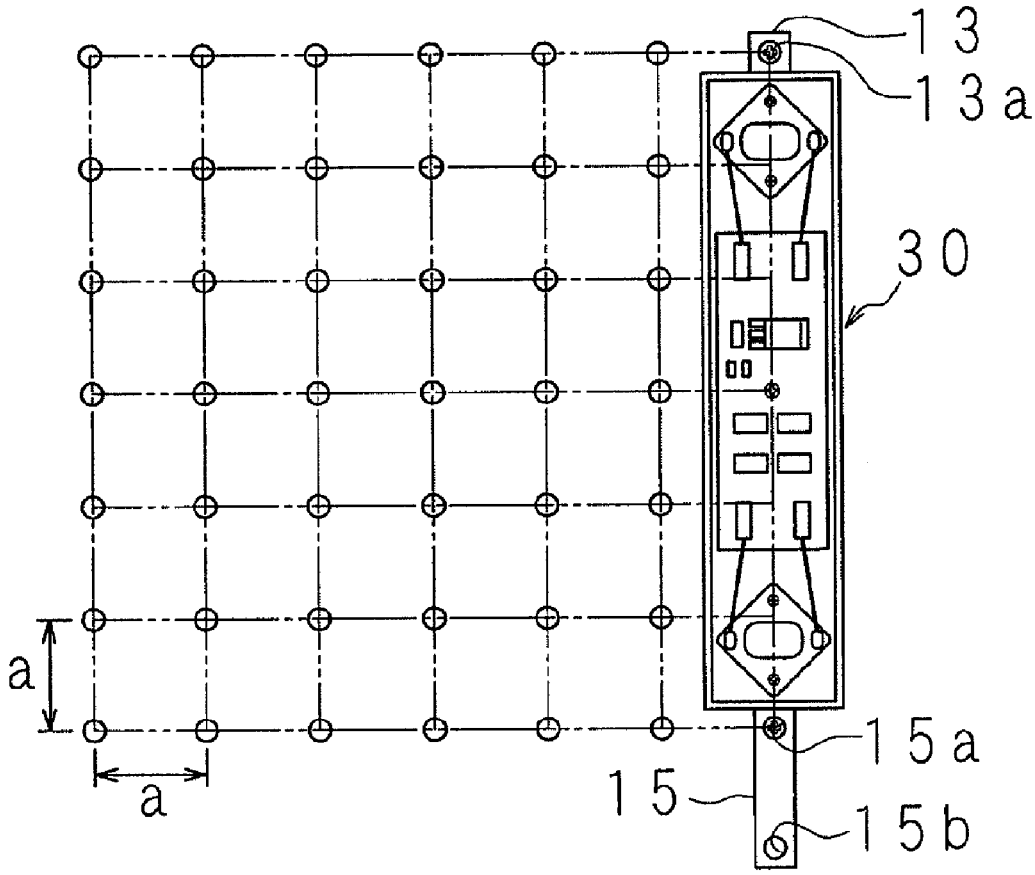
FIG. 14C is a conceptual view explaining a fixing method of the light source unit.

FIG. 14A, as well as FIG. 14B and FIG. 14C, is a conceptual view explaining a fixing method of the light source unit 30. As the light source unit 30 is fixed to the product, such as the lighting apparatus and the notice bearing apparatus, the threaded holes are arranged along lattice shapes with the same pitch "a" away from each other on a casing or a fixing portion for fixing a fixing plate on the casing. In the case that each light source unit 30 is aligned along the threaded holes in the horizontal direction or the vertical direction of the figure as shown in FIG. 14A or FIG. 14C, the light source unit 30 is fixed by a screw threading into the threaded hole 13*a* formed at the fixing projection 13 of the module casing 1*b* and by a screw threading into the threaded hole 15*a* of the fixing portion 15 closer to the module casing 1*b*. In the case that each light source unit 30 is aligned in a direction with 45 degree angle against the arranged threaded holes as shown in FIG. 14B, the light source unit 30 is fixed by a screw threading into the threaded hole 13*a* formed at the fixing projection 13 of the module casing 1*b* and by a screw threading into the threaded hole 15*b* of the fixing portion 15 far to the module casing 1*b*. The pitch "a" of the threaded hole is set, for example, 20 mm.

Since the light source unit 30 and the casing fixing the light source unit 30 are configured as described above, it is possible to fix the light source unit 30 at the desired position with changing the fixing direction in 45 degree and to facilitate the fixing works of the light source unit 30 to the casing.

Although the distance between the LED modules 3, 3 is illustrated to be 10 cm in the embodiments described above, the present invention is not limited to 10 cm. The distance should be set properly in accordance with the product, such as the lighting apparatus and the notice bearing apparatus, provided with the light source unit.

Although the light source unit is illustrated to have two LED modules in the embodiments described above, the present invention is not limited to two LED modules. Alternatively, the light source unit may be provided with not less than three LED modules. In such an alternative case, even number is preferred for a number of the LED modules. Although the light source is illustrated to be the high intensity LED module in the embodiments described above, the present invention is not limited to such the LED module. Alternatively, the light source may be configured with a high intensity LED chip. Although the light source is illustrated to be the LED in the embodiments described above, the present invention is not limited to such the LED.

Although the light source unit is illustrated to be applied to the interiorly illuminating signboard in the embodiments described above, the present invention is not limited to the interiorly illuminating signboard. Alternatively, the light source unit may be applied to the self illuminating signboard, to a notice bearing apparatus such as an indicator, and even to a lighting apparatus other than the notice bearing apparatus. The light source unit may be utilized not only the outside but also the inside. For example, the light source unit may be applied to a lighting apparatus illuminating the object in the showcase, since being modularized and then having the design flexibility for the arrangement. For example, the light source unit may be applied to a lighting apparatus located at a place where water is utilized or at a place where dew condensation occurs frequently, since having high water proofing property. A lighting apparatus is supposed as the latter example to be located inside a refrigerator, located on an outer wall or an inner wall of a building for lighting on footsteps, or located at a lower place on a street for lighting on footsteps.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. A light source unit comprising:

a plurality of light source sections, each of which emits light; and a current supplying section that supplies constant current to the plurality of light source sections, the current supplying section including a regulator that regulates power from an external source to the constant current; and a casing that accommodates the plurality of light source sections and the current supplying section, wherein the current supplying section is physically arranged on the casing between the plurality of light source sections.

2. A light source unit according to claim 1, wherein the plurality of light source sections are serially connected.

3. A light source unit according to claim 1, wherein a distance between the current supplying section and one of the light source sections is substantially the same as another distance between the current supplying section and another one of the light source sections.

4. A light source unit according to claim 1, wherein each of the light source sections is configured with a plurality of LEDs.

5. A light source unit according to claim 1, wherein a number of the light source sections is two.

6. A light source unit according to claim 1, wherein the casing has a flat surface, and the plurality of light source sections and the current supplying section are aligned on the flat surface.

7. A light source unit according to claim 4, wherein the plurality of LEDs are connected in parallel.

8. A light source unit according to claim 6, wherein the current supplying section comprises a connect section that is connected to a power supply electric cable, and the plurality of light source sections emit light in a direction toward the connect section from a contact portion where the flat surface contacts with the current supplying section.

9. A light source unit according to claim 6, wherein a thermally conductive sheet is inserted between the flat surface and the plurality of light source units.

10. A light source unit according to claim 6, wherein a thermally conductive sheet is inserted between the flat surface and the current supplying section.

11. A light source unit according to claim 6, wherein the casing is filled inside with a resin.

12. A light source unit according to claim 6, wherein the casing comprises a partition member for partitioning the plurality of light source sections and the current supplying section.

13. A lighting apparatus, comprising:

a plurality of light source units, wherein each of the light source units comprises:

a plurality of light source sections, each of which emits light; and a current supplying section that supplies constant current to the plurality of light source sections, the current supplying section including a regulator that regulates power from an external source to the constant current; and a casing that accommodates the plurality of light source sections and the current supplying section, wherein the current supplying section in each of the light source units is physically arranged on the casing between the plurality of light source sections.

14. A lighting apparatus according to claim 13, wherein an adjacent light source section distance between two adjacent light source sections among the light source sections arranged in the lighting apparatus is substantially the same as another adjacent light source section distance between another two adjacent light source sections among the light source sections arranged in the lighting apparatus.

15. A lighting apparatus according to claim 14, further comprising:

a diffuser panel that diffuses the light emitted by the plurality of light source units, wherein the adjacent light source section distance is not more than a distance between the diffuser panel and the respective light source units.

16. A notice bearing apparatus comprising:

a plurality of light source units, wherein each of the light source units comprises:

a plurality of light source sections, each of which emits light; and a current supplying section that supplies constant current to the plurality of light source sections, the current supplying section including a regulator that regulates power from an external source to the constant current; and a casing that accommodates the plurality of light source sections and the current supplying section, wherein the current supplying section in each of the light source units is physically arranged on the casing between the plurality of light source sections.

17. A notice bearing apparatus according to claim 16, wherein an adjacent light source section distance between two adjacent light source sections among the light source sections arranged in the notice bearing apparatus is substantially the same as another adjacent light source section distance between another two adjacent light source sections among the light source sections arranged in the notice bearing apparatus.

18. A notice bearing apparatus according to claim 16, wherein each of the light source sections is configured with a plurality of LEDs.

19. A notice bearing apparatus according to claim 17, further comprising:

a diffuser panel that diffuses the light emitted by the plurality of light source units, wherein the adjacent light source section distance is not more than a distance between the diffuser panel and the respective light source units.

* * * * *